United States Patent [19]

Hatfield

[11] 4,372,553

[45] Feb. 8, 1983

[54] WEIGHT LIFTING DEVICE AND METHOD OF EXERCISING

[76] Inventor: Frederick C. Hatfield, 502 Twenty-seventh St., Kenner, La. 70062

[21] Appl. No.: 203,417

[22] Filed: Nov. 3, 1980

[51] Int. Cl.[3] ..... A63B 21/12

[52] U.S. Cl. ..... 272/119; 272/134; 272/136; 272/142

[58] Field of Search ..... 272/117, 121, 143, 134, 272/144, 116, 900, DIG. 4, 133, 130, 136, 142

[56] References Cited

U.S. PATENT DOCUMENTS 3,072,400 1/1963 Dykinga ..... 272/134 X

FOREIGN PATENT DOCUMENTS 2211551 9/1973 Fed. Rep. of Germany ..... 272/119

*Primary Examiner*—Richard C. Pinkham
*Assistant Examiner*—William R. Browne
*Attorney, Agent, or Firm*—C. Emmett Pugh & Associates

[57] ABSTRACT

An exercising system for exercising the abdominal muscles in which the abdominal muscles are isolated and placed "on stretch" prior to contracture comprising an exercising device having a seat with a posteriorly curved, firm back in which the user sits and secures himself and bends forward working against a progressive force resistance system using weights supported on a pulley system (three exemplary pulley systems being illustrated in FIGS. 1–3) or using a resilient, stretch material (FIGS. 4 and 5) connected by means of shoulder harness with straps to the upper shoulder portions of the user, with the user strapped into place with a seat belt. In use, the exerciser simply straps himself into the seat, puts the shoulder harness on and lies back against the posteriorly curved back which puts the abdominals in stretch. Then, by "crunching" the entire upper torso forward (as though an attempt were being made to put the face on the knees), the resisting weights are moved or the material stretched and the abdominals are exercised in isolation, with the exercise repeated as long as desired.

13 Claims, 6 Drawing Figures

WEIGHT LIFTING DEVICE AND METHOD OF EXERCISING

BACKGROUND OF THE INVENTION

1. Field of the Invention

The present invention is directed to an exercising system for exercising the muscles, and in particular such a system for exercising the abdominal muscles by use of a machine in which the user sits and works against force resisting weights or stretch materials and the like.

2. Prior Art

There are many machines and methods in the prior art designed to exercise the body and its various muscle sets.

Additionally, of course, there are various exercising machines designed for the exerciser to sit in them and to exercise various parts of the body by working against weights or other force resisting systems associated with the seat; note for example the patent to Zinkin (U.S. Pat. No. 3,743,282, issued July 3, 1973). Additionally, as a broad concept, devices which can be used to exercise the abdominal muscles, inter alia, are also known; note for example the patents to Pfotenhauer (U.S. Pat. No. 3,948,513, issued Apr. 6, 1976; see particularly FIGS. 8*i* and 8*j*) and to McDonough (U.S. Pat. No. 3,285,070, issued Nov. 15, 1966; see particularly FIG. 9); and note also the standard bench press or slant board devices which with hand held weights can be used to exercise, inter alia, the abdominals.

Also, take in abstract isolation, individual elements of the present invention or specific features of the invention in other combinations have been known. Thus, with respect to, for example, seat belts or leg belts, note for example the McDonough patent supra (FIG. 6) and the DeLorme, Jr., et al patent (U.S. Pat. No. 3,323,366, issued June 6, 1967). For shoulder harnesses generally, note for example the patents to Moore (U.S. Pat. No. 3,370,850, issued Feb. 27, 1968) and to Heisler et al (U.S. Pat. No. 3,152,802, issued Oct. 13, 1964).

With respect to exercisers involving seats, note for example the Zinkin patent supra, the Yount et al patent (U.S. Pat. No. 3,759,512, issued Sept. 18, 1973), the Aronshol patent (U.S. Pat. No. 3,017,180 issued Jan. 16, 1972) and the Feather, et al patent (U.S. Pat. No. 3,712,613, issued Jan. 23, 1973. The patent to Wisby (U.S. Pat. No. 2,482,996, issued Sept. 27, 1949) illustrates a posture corrective chair having a curved back of spring steel and is not really considered part of the prior art of the present invention, nor is the back massaging machine of the Weaver patent (U.S. Pat. No. 1,929,107, issued Oct. 3, 1933), but these latter patents are merely being listed as having been incidentally noted in a patentability search.

With respect to exemplary pulley/weight systems note for example the patents to Proctor (U.S. Pat. No. 3,640,527, issued Feb. 8, 1972), McArthur (U.S. Pat. No. 4,125,258, issued Nov. 14, 1978), Lambert, Jr. (U.S. Pat. No. 4,149,714, issued Apr. 17, 1979), Flannery (U.S. Pat. No. 4,084,815, issued Apr. 18, 1978) and the Zinkin patent supra. With respect to exercising or therapeutic devices in which broadly speaking the forced resistant or guidance system is applied from above and/or behind, note for example the patents to Flannery supra, Walker (U.S. Pat. No. 3,709,487, issued Jan. 9, 1973) and Jensen (U.S. Pat. No. 3,033,198, issued May 8, 1962).

However, none of these patents in any proper combination fairly suggest or teach the inventive combination of the present invention.

In particular, it has been long desired to have a exercising device which could isolate the abdominal muscles, whereas the methods and devices of the prior art used to exercise the abdominals required the strength of the hip flexor muscle (that is the quadriceps groups and the iliopsoas muscle). By isolating the abdominals, as achieved in the present invention, the incidence of low-back injury and hip flexor injury is totally eliminated.

Additionally, the abdominal muscles in the present invention can be exercised in a seated position, and the machine of the present invention requires the person using it to place the abdominal muscles "on stretch" prior to contracture. Finally, in contradistinction to the prior art, the system of the present invention is, it is believed, innovative in so far as it utilizes the progressive resistance principle by means of the use of weights in an abdominal muscle exercising system.

3. Summary Discussion of Invention

The abdominal muscle exercising system of the present invention is constructed to allow the exerciser to sit upright against a posteriorly curved, firm or relatively hard seatback. The curve of the seatback causes the muscles in the front of the trunk of the body i.e. the abdominals, to be stretched prior to contracture.

In the present invention, a shoulder harness, which is easily slipped into from the seated position, is affixed to preferrably a progressive resistance force system applied from the back and overhead for example to a top pulley of a forced resistant system by means of for example a chain or cable or other line. From the top pulley, the chain or cable or other line descends to the weight resistant system through appropriate linkages and pulleys as desired, and several exemplary versions (FIGS. 1–3) of this forced resistance system is disclosed herein. Alternatively, a resilient, stretch material, such as for example surgical tubing could be used (FIGS. 4 and 5).

In use, the exerciser simply straps himself into the seat of the machine of the present invention, puts the shoulder harness on and lies back against the posteriorly curved back which puts the abdominals in stretch. Then, by "crunching" the entire upper torso forward (as though an attempt were being made to put the face on the knees), the force resisting weights are moved or stretched and the abdominals are exercised in isolation, with the exercise repeated as long as desired.

Thus it is a basic object of the present invention to provide an exercising system for the abdominal muscles in which the abdominals are exercised in isolation and in which the abdominals are put on stretch before the abdominal exercise is actually done, and to achieve this highly desired and long sought after result with a compact, relatively inexpensive and reliable machine.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein:

FIG. 1 is a side view of the preferred embodiment of the abdominal exercising device of the present invention with a first, exemplary embodiment of the force resisting weight/pulley system; while

FIG. 4 is a front, perspective view of a second embodiment (with the seat in phantom line) of the abdominal exercising device, similar in over-all structure to the embodiment of FIG. 1 but with a resilient stretch material used for the force resistant system; while

DETAILED DESCRIPTION OF PREFERRED EMBODIMENTS

Figure 1:
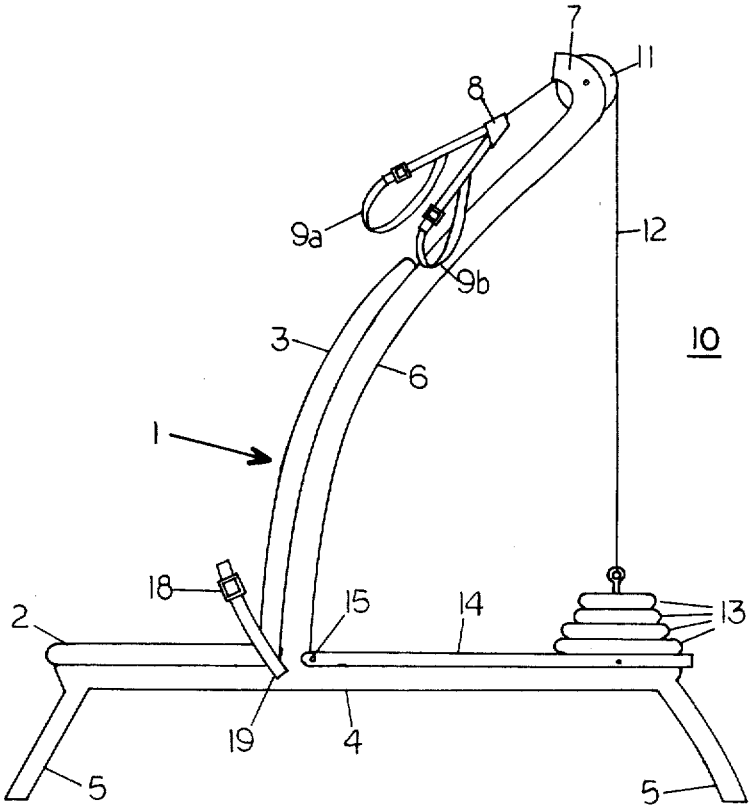

As can be seen in FIG. 1, the preferred embodiment of the abdominal muscle exercising device of the present invention comprises a seat 1, including a cushioned seat bottom 2 and a curved, cushioned but firm seatback 3. The curved seat back 3 is supported on a basic frame 4 by a upwardly extending, curved seatback supports 6 upon which the firm, relatively hard back seat cushion 3 is mounted. The support base 4 includes a set of four legs 5 for support of the exerciser or user above the floor level. A seat belt or restraining strap 19 with seat buckle 18 is included for the user to strap himself into the seat 1 (also note FIG. 6).

At the upper portion of the device, there is included a shoulder harness 8 having two shoulder straps 9*a* and 9*b* which can be easily slipped into by the user's placing his arms through the shoulder loops or straps 9*a* and 9*b* (also note FIG. 6), which are preferrably adjustable in size. The shoulder harness 8 with its straps 9*a* and 9*b* can be made of for example leather or other flexible type belting material.

Preferrably positioned behind the seatback 3 and its support 6 is a force resisting weight/pulley system 10 utilizing a progressive resistance principle. The pulley/-weight system 10 includes an initial upper pulley wheel or sheeve 11 supported for rotation on the upper end 7 of the seatback support member 6, with a cable or line 12 being connected from the upper end of the shoulder harness 8 around the pulley wheel 11 down to the upper portion of a series of weights 13. It should be noted that the positioning of the shoulder harness 8 and the top pulley wheel 11 cause the force resistance to the forward movement of the user to be applied from above and behind the user.

Figure 6:
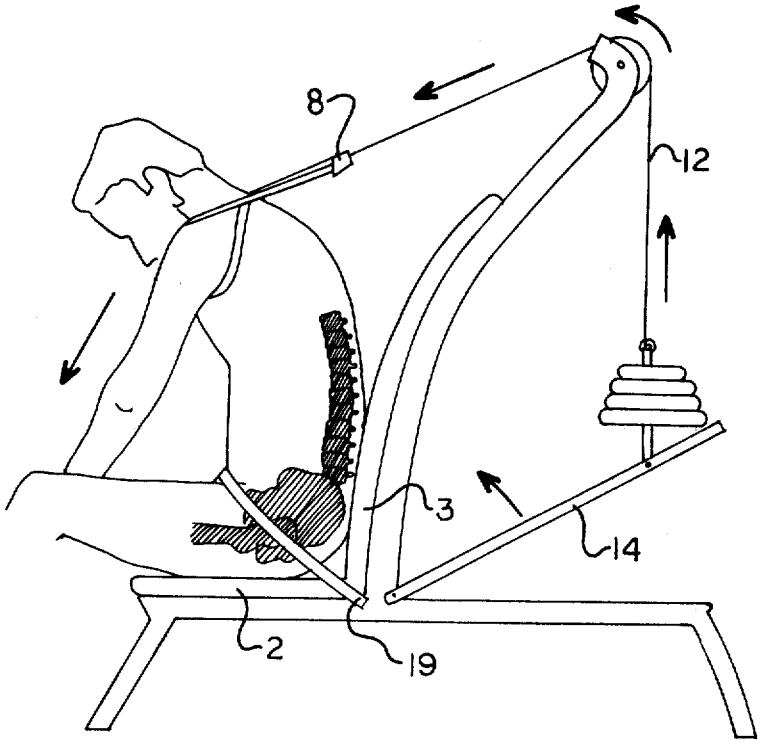
FIG. 6 is a side view of the embodiment of FIG. 1 in use, generally illustrating the isolation of the abdominals from the hip flexor and generally illustrating by directional arrows the relative movements involved in the system of the present invention.

The weights 13 can be, if desired, supported on a swivel base 14 to which the weights are connected and which pivots about pin 15 as the weights 13 move up and down under the action of the user working against the shoulder straps 9*a* and 9*b* (also note FIG. 6). The upper pulley wheel 11 can be for example a pulley wheel having an exemplary diameter of five inches supported on for example brass bushings. The line 12 can be for example made up of quarter inch steel cable with a plastic sleeve or can be provided in the form of a bicycle chain with the upper pulley wheel 11 being provided in the form of a sprocket if desired.

The device can be provided to the consumer with merely a weight rack mounted on the swivel 14, with the particular weights 13 being provided by the user in the form of for example standard, readily available discs of varying amounts of weight.

Figure 2:
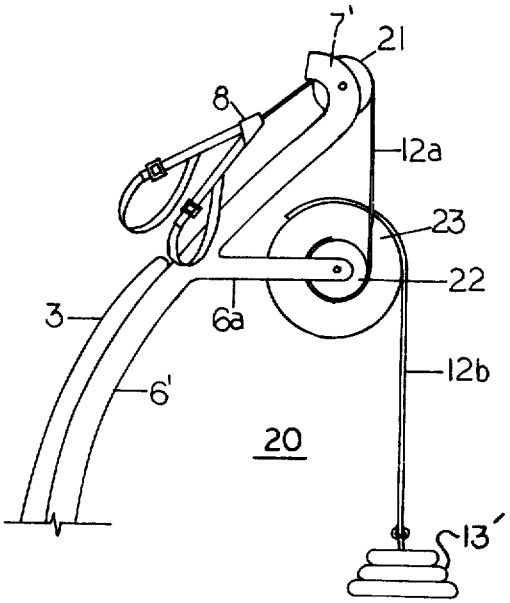
FIG. 2 is a side, partial view of an exemplary, second embodiment of the force resisting weight/pulley system for the abdominal exercising device of the present invention.
Figure 3:
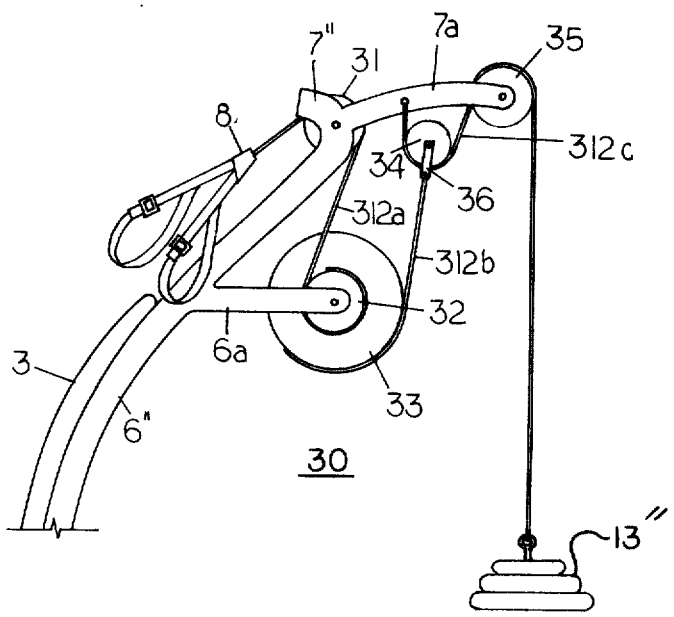
FIG. 3 is a side, partial view of a further exemplary, third embodiment of the force resisting weight/pulley system for the abdominal exercising device of the present invention.

The forced resistant pulley/weight system 10 can be provided in many other different forms that that shown in FIG. 1, such as for example, the exemplary alternate systems illustrated in FIGS. 2 and 3.

For example, in FIG. 2, the weight/pulley system 20 comprises an upper pulley wheel or sleeve 21 supported for rotation on the upper end 7' of the basic back supports 6', while further pulley wheels 22, 23 are affixedly supported together for rotation on support arms 6*a* extending back from the basic back supports 6'. Line 12*a* extends from the shoulder harness 8 down to the smaller, middle pulley wheel 22, while a second line 12*b* extends from the periphery of the larger, middle pulley wheel 23 down to the weights 13'. Thus, as the shoulder harness 8 is pulled forward under the action of the exerciser, the magnitude of the resisting force of the weights 13' is substantially multiplied by the relative diameter relationships between the middle pulley wheels 22 and 23.

In FIG. 3, the weight/pulley system 30 again comprises an upper pulley wheel or sleeve 31, mounted at the upper end 7" of the basic back support 6", and a smaller, middle pulley wheel 32 with a larger, middle pulley wheel 33 affixed thereto for combined rotation on middle support arms 6*a* extending back from the basic back supports 6". However in the system 30, there is further included a floating pulley wheel 34 and an upper, rear pulley wheel or sleeve 35 carried by the upper extension arms 7*a*, with a total of three pulley lines 312*a*, 312*b*, and 312*c* being provided, with initial line 312*a* being connected to the shoulder harness 8, the final pulley line 312*c* being connected to the weights 13", and the intermediate pulley line 312*b* being connected from the periphery of the larger, middle pulley wheel 33 to the axle support fork 36 of the floating pulley wheel 34. Again, the resisting force of the weight/pulley system is greatly magnified by the alternate embodiment of FIG. 3 requiring lesser amounts of weights 13" than that included in either the embodiments of FIG. 2 and its weight 13' and FIG. 1 and its weight 13.

Figure 5:
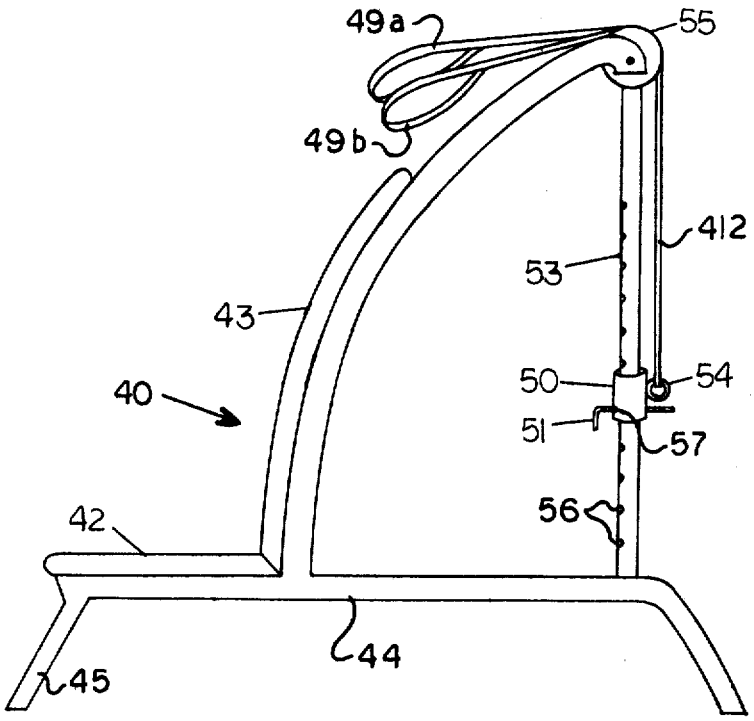
FIG. 5 is a side view of the embodiment of FIG. 4.
Figure 4:
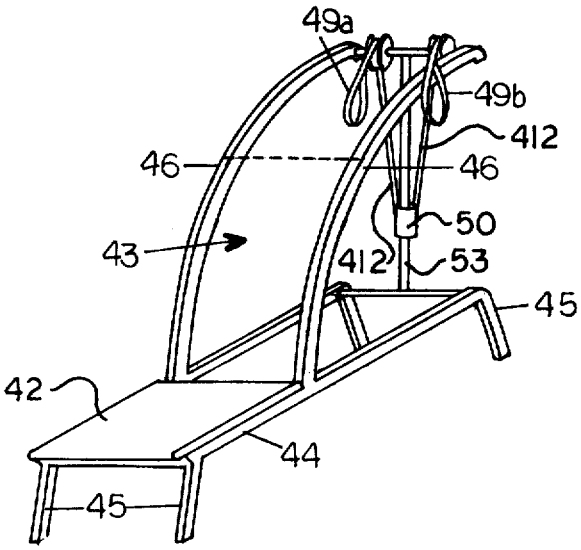

Of course, in addition to various types of pulley/-weight, force resisting systems, other forms of force resistant systems could be used, such as for example, springs or elastic members such as for example surgical tubing and such an embodiment is shown in FIGS. 4 & 5.

It is noted that the basic structural frame 44, 45, and 46 and the seat 40 (bottom 42 and curved back 43) of the embodiment of FIGS. 4 & 5 are similar to the frame elements 4, 5, and 6 and the seat 1 (bottom 2 and the curved back 3) of the embodiment of FIG. 1. Hence detail discussion of these similar elements will not be repeated. However, it is further noted that, for simplicity purposes and to expose the back frame structure, the curved seat back 43 is only shown in phantom line in FIG. 4.

Rather than a pulley/weight force resisting system, stretchable, resilient material, such as for example surgical tubing, is used for the lines 412 which lead to the shoulder harness straps 49*a* and 49*b* over sheeve wheels 55. The distal ends of the stretchable lines 412 are fixedly attached by means of pad eye 54 to adjustable collar 50.

As can best be seen in FIG. 4, the collar 50 can be positioned up along the vertical support post 53 at a desired vertical position and held there in place by the key pin 51 being inserted through the selected one of the vertical series of pin holes 56 and the corresponding mating hole 57 in the collar 50. The lower down the collar 50 is positioned on the post 53, the greater will be the resistance of the stretchable lines 412 to the movement of the exerciser working against the shoulder straps 49*a* and 49*b*, and vice versa.

In FIG. 6 the relative movements of the elements of the preferred embodiment of the exercising system of the present invention are seen, as generally illustrated by the various direction arrows. It is noted that the resisting force is applied from above and behind the user against the shoulders of the user, while the posterior of the user is firmly held in place by the restraining strap or seat belt 19 against the seat elements 2 and 3 and toward the intersection between the two of them, that is toward the base of the curved seat back 3. This at least generally isolates the abdominals, which are the active muscles in the exerciser of the present invention, from the iliopsoas or hip flexor muscles, which unlike other prior art exercisers, are at least generally not active in the exerciser of the present invention. It is noted that the hip flexor originates with the lumbar spine and extends to the legs or femors (thigh bones). Were it not for this isolation, the abdominals would not receive the degree of exercising desired and any use of the hip flexor runs a substantial risk of causing lower back pain, as is common to other prior art so-called "abdominal" exercisers.

Exemplary dimensions for an embodiment of the exerciser of FIGS. 1 and 6 and outlined below:

Stance of distance between front legs and back legs 5: 36"
height of legs 5: 16"
size of frame members 4,5,6: ¾" tubing
height of sheeve wheel 11 above ground level: 48"
seat back 3: 1" foam rubber over plywood base
curvature of back 3: 38" radius producing a 38.5" cord from the top of seat bottom 2 to the sheeve 11
depth of seat cushion 2: 11"

Although the seating arrangement illustrated is preferred, it is possible also to design a system in accordance with the principles of the present invention in which the support legs 5 and the seat bottom 2 are eliminated, as long as the seat backing 3–6 are fixed with respect to the posterior of the user. Additionally, although the upright seated position illustrated is preferred, it is possible to achieve the beneficial effects of the present invention with a system in which the user is not on a horizontal seat but rather is seated at an angle further back toward the supine position with, in effect, the user's legs up in the air.

However, it is very important to the operation and principles of the present invention that the seat back 3–6 have a substantially posteriorly curved back in order to place the abdominal muscles "on stretch" prior to the contracture which occurs when the exercising begins, although a significant degree of variation in the curvature is possible within the scope of the present invention. For example, for a one to three foot range in a segment of a circle, the radius can range from one to eight feet. Thus, the abdominal muscle exercising machine of the present invention is constructed to allow the exerciser to sit upright against the posteriorly curved seat back. This curve causes the muscles in the front of the trunk to be stretched.

Additionally, although having a seat belt or restraining strap 19 included in the device is preferred, it is possible to use a similar device and derive substantial benefit from the principles of the present invention without the use of such a seat belt. However, having the seat belt keeps the user from "cheating" by leaning forward but instead restrains the user so that the user's seat is firmly positioned back against the lower portion of the seatback 3 and the back portion of the seat bottom 2, which action isolates the abdominals from the hip flexor and causes the exercising to be directed to the abdominals.

Because of the many varying embodiments that may be made within the scope of the inventive concept herein taught, and because many modifications may be made in the embodiments herein detailed in accordance with the disclosure requirements of the law, it is to be understood that the details herein are to be interpreted as illustrative and not in a limiting sense.

What is claimed is:

1. An exercising device for exercising the abdominal muscles of the user by causing the user to contract them, comprising:

a support frame;

a seat having seat back means mounted on said support frame and against which the user sits and is supported for putting the abdominals on stretch before contracture of the abdominals which occurs during the exercising, said seat back means comprising a posteriorly curved, firm seat back which is substantially curved in the area where the user's spine is located causing the user's back to be hyperextended by being curved backwardly a significant amount when seated in the device;

force resistance means associated with said support frame for resisting but allowing the forward movement of the user in said seat when the user moves forwardly away from said seat back means to cause the abdominals to be contracted; and moveable shoulder area connection means directly connected to said force resistance means for directly connecting the upper body, shoulder areas of the user to said force resistance means and for applying the force resistance of said force resistance means directly to the upper body, shoulder areas of the user in a direction opposite to the user's movement away from said seat back means but allowing the user to move forwardly against the force resistance.

2. The exercising device of claim 1, wherein there is further included restraining strap means associated with said support frame and said seat back means for strapping the user firmly back toward the base of said curved seat back assuring that the abdominals are at least generally isolated from the hip flexor muscles during the exercising.

3. The exercising device of claim 1, wherein said shoulder area connection means includes a shoulder harness with at least one force resistance line connected to it, said line extending upwardly and backwardly with respect to said shoulder harness causing the force resistance to be applied from above and behind the user.

4. The exercising device of claim 3, wherein said support frame includes an upwardly and backwardly extending, curved support member serving as a support for said seat back and extending higher than said seat back, and wherein there is further included a guide mounted at the top of said curved support member, said line extending from said shoulder harness up to said guide and then down to said force resistance means.

5. The exercising device of either claims 1 or 4, wherein at least most of said force resistance means is mounted on said support frame and is located behind said curved seat back.

6. The exercising device of claim 1, wherein said support frame includes at least three support legs, and wherein said seat has a bottom which is at least generally horizontally disposed.

7. The exercising device of claim 1, wherein said force resistance means comprises a pulley-and-weight system in which the movement of said shoulder area connection means moves a weight in at least a generally vertical direction.

8. The exercising device of claim 1, wherein said force resistance means comprises a resilient, stretchable material in which the movement of said shoulder area connection means away from said seat back stretches said material, resisting the movement.

9. The exerciser of claim 1, wherein the radius of the curvature of said posteriorly curved seat back is in the range of one to eight feet for a one to three foot range in the segment of the curve.

10. The method of exercising the abdominal muscles of the body, comprising the following steps:

(a) providing an exercising device, including
- a support frame;
- a seat having seat back means mounted on said support frame, said seat back means comprising a posteriorly curved, firm seat back in the area where the user's spine is located during use;
- restraining strap means associated with said support frame and said seat back means;
- force resistance means associated with said support frame; and
- shoulder area connection means connected to said force resistance means;

(b) sitting in said seat and strapping said restraining strap means to firmly hold the user's posterior back against said curved seat back and toward its base at least generally isolating the abdominals from the hip flexor muscles, and directly connecting said shoulder area connection means directly to the shoulder area of the upper body to apply the force resistance of said force resistance means in a direction directly opposite to any movement away from said seat back means;

(c) leaning back against said curved seat back putting the abdominals in stretch before exercising; and (d) cyclically moving the upper torso forwardly away from said seat back against the resisting force of said force resistance means and then back again, thereby exercising the abdominals, the abdominal muscles contracting concentrically to move the spine from spinal hyperextension, through extention, to flexion, then contracting eccentrically to move the spine from flexion, back through extention and back to hyperextension.

11. An exercising device for exercising the abdominal muscles of the user by causing the user to contract them, comprising:

a support frame;

a seat having seat back means mounted on said support frame and against which the user sits and is supported;

force resistance means associated with said support frame for resisting but allowing the forward movement of the user in said seat when the user moves forwardly away from said seat back means to cause the abdominals to be contracted; and moveable shoulder area connection means directly connected to said force resistance means for directly connecting the upper body, shoulder areas of the user to said force resistance means and for applying the force resistance of said force resistance means directly to the upper body, shoulder areas of the user in a direction opposite to the user's movement away from said seat back means but allowing the user to move forwardly against the force resistance;

said force resisting means including at least one force resistance line connected to said shoulder area connection means, said line extending initially upwardly and backwardly with respect to said shoulder area connection means causing the force resistance to be applied from above and behind the back of the user directly against the shoulder area of the user.

12. The exercising device of claim 11, wherein said shoulder area connection means includes a shoulder harness, and wherein said support frame includes an upwardly and backwardly extending, curved support member serving as a support for said seat back and extending higher than said seat back, and wherein there is further included a guide mounted at the top of said curved support member, said force resistance line initially extending from said shoulder harness up to said guide and then down to said force resistance means.

13. The exercising device of claim 12, wherein said force resistance means comprises a pulley-and-weight system in which the movement of said shoulder area connection means moves a weight located below said guide in at least a generally vertical direction.

* * * * *